US005228390A

United States Patent [19]

Jahn

[11] Patent Number: 5,228,390

[45] Date of Patent: Jul. 20, 1993

[54] ROTARY PRINTING MACHINE WITH DEVICE FOR ENGAGING A LACQUERING/RUBBER-COVERED CYLINDER WITH AND DISENGAGING IT FROM AN IMPRESSION CYLINDER AND/OR A METERING/PLATE CYLINDER

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 564,150

[22] Filed: Aug. 7, 1990

[30] Foreign Application Priority Data

Aug. 7, 1989 [DE] Fed. Rep. of Germany ..... 3926088

[51] Int. Cl.[5] ..... B41F 31/00

[52] U.S. Cl. ..... 101/352; 101/182; 101/209; 101/247; 101/351

[58] Field of Search ..... 101/349-352, 101/182, 184, 185, 209, 247, 284, 285, 139, 140, 137, 143-145, 216-218

[56] References Cited

U.S. PATENT DOCUMENTS

| | | | |
|---|---|---|---|
| 3,552,313 | 1/1971 | Jeschke | 101/218 |
| 3,584,578 | 6/1971 | Jurny | 101/218 |
| 3,618,516 | 11/1971 | Jurny | 101/218 |
| 4,080,895 | 3/1978 | Liska | 101/218 |
| 4,423,678 | 1/1984 | Matsumoto | 101/248 |
| 4,458,591 | 7/1984 | Guaraldi | 101/247 |
| 4,488,484 | 12/1984 | Jiruse et al. | 101/248 |
| 4,598,640 | 7/1986 | Nawrath | 101/177 |
| 4,833,982 | 5/1989 | Liebert et al. | 101/177 |
| 5,081,927 | 1/1992 | Jahn | 101/352 X |

FOREIGN PATENT DOCUMENTS

| | | | |
|---|---|---|---|
| 1176673 | 8/1964 | Fed. Rep. of Germany . | |
| 7125259 | 7/1971 | Fed. Rep. of Germany . | |
| 2153690 | 12/1974 | Fed. Rep. of Germany . | |
| 3412812 | 6/1985 | Fed. Rep. of Germany . | |
| 3614027 | 3/1988 | Fed. Rep. of Germany . | |
| 2507961 | 12/1982 | France . | |
| 1118197 | 6/1968 | United Kingdom | 101/218 |
| 1249004 | 10/1971 | United Kingdom . | |

*Primary Examiner*—Edgar S. Burr
*Assistant Examiner*—Christopher A. Bennett
*Attorney, Agent, or Firm*—Herbert L. Lerner; Laurence A. Greenberg

[57] ABSTRACT

In a rotary printing machine, there is provided a device for bringing a lacquering/inking cylinder into and out of engagement with at least one of a pair of cylinders including an impression cylinder, the lacquering/inking cylinder being mounted on a shaft, which includes a substantially circular ring turnably disposed on the shaft of the lacquering/inking cylinder, the ring being spring-biased towards two bracing stops and being formed with an indentation at a section of the circumference thereof, the ring being turnable on the shaft so as to move the indented section of the circumference thereof into a position opposite one of the bracing stops for bringing the lacquering/inking cylinder out of engagement with the impression cylinder, the ring being spring-biased in a direction towards the other of the pair of cylinders, the other of the bracing stops being disposed in an open angle formed by an intersection of a line connecting respective axes of the lacquering/inking cylinder and the impression cylinder and a line extending substantially from the axis of the lacquering/inking cylinder to the axes of the other pair of cylinders, and being displaceable by remote control.

10 Claims, 4 Drawing Sheets

ROTARY PRINTING MACHINE WITH DEVICE FOR ENGAGING A LACQUERING/RUBBER-COVERED CYLINDER WITH AND DISENGAGING IT FROM AN IMPRESSION CYLINDER AND/OR A METERING/PLATE CYLINDER

The invention relates to a device in a rotary printing machine for bringing a lacquering or rubber-covered inking cylinder into and out of engagement with at least one of a pair of cylinders including an impression cylinder, the lacquering or rubber-covered inking cylinder being mounted on a shaft.

In conventional constructions of this general type (U.S. Pat. No. 3,552,313), circumferential sections which are indented from a circularly shaped ring are formed as flats, each of which is assigned to a counterpressure roller. When a first flat is in a position opposite a first counterpressure roller, the rubber-covered cylinder is lifted off the impression cylinder as a result of spring loading or bias; as the ring moves on so that a second flat comes into a position opposite a second counterpressure roller, the rubber-covered cylinder is lifted of the plate cylinder. The corresponding disengagement positions of the rubber-covered cylinder have limited stability, which is disadvantageous particularly in the case of high-speed presses. For this reason, in particular, the corresponding counterpressure rollers are, in turn, also adjustable in that they are seated on eccentric shafts which are movable by threaded spindles. This adjustability of the counterpressure rollers serves only for accurately determining the respective positions of the rubber-covered cylinder when it is engaged with and disengaged from the other two cylinders. It has nothing to do with the engagement and disengagement motion during its use. A further disadvantage of the heretofore known constructions is that, in order to disengage the rubber-covered cylinder from the plate cylinder, it is basically necessary, first of all to pass through the disengagement travel which removes or separates the rubber-covered cylinder from the impression cylinder. This constitutes a considerable disadvantage in use particularly because it is not possible then to effect a multiple inking of the inking or rubber-covered cylinder or, in the case of a lacquering unit, of the lacquering cylinder, for which purpose multiple revolutions of the cylinders to be inked or lacquered are necessary.

It is accordingly an object of the invention to provide a rotary printing press with a device of the foregoing general type having a mechanical construction for effecting engagement and disengagement motions which is more advantageous with regard to expense of manufacture and is also more favorable with regard to the operation thereof, which permits, in particular, considerably greater precision in the construction of the device and in the engagement and disengagement motions.

With the foregoing and other objects in view, there is provided, in accordance with the invention in a rotary printing machine, a device for bringing a lacquering-/inking cylinder into and out of engagement with at least one of a pair of cylinders including an impression cylinder, the lacquering/inking cylinder being mounted on a shaft, comprising a substantially circular ring turnably disposed on the shaft of the lacquering/inking cylinder, the ring being spring-biased towards two bracing stops and being formed with an indentation at a section of the circumference thereof, the ring being turnable on the shaft so as to move the indented section of the circumference thereof into a position opposite one of the bracing stops for bringing the lacquering-/inking cylinder out of engagement with the impression cylinder, the ring being spring-biased in a direction towards the other of the pair of cylinders, the other of the bracing stops being disposed in an open angle formed by an intersection of a line connecting respective axes of the lacquering/inking cylinder and the impression cylinder and a line extending substantially from the axis of the lacquering/inking cylinder to the axes of the other pair of cylinders, and being displaceable by remote control.

In accordance with another feature of the invention, the other of the pair of cylinders is a metering cylinder.

In accordance with a further feature of the invention, the other of the pair of cylinders is a plate cylinder.

In accordance with an added feature of the invention, there is provided a control cam formed on the ring, the displaceable other bracing stop being cooperatively engageable with the control cam.

In accordance with an additional feature of the invention, the one bracing stop is disposed on a rectilinear extension of the line connecting the respective axes of the lacquering/inking cylinder and the impression cylinder, the one bracing stop being cooperatively receivable in an insert channel forming the indentation at the section of the ring circumference.

In accordance with again another feature of the invention, the displaceable other bracing stop is seated on a lever which is swivellable about a fixed bearing location.

In accordance with again a further feature of the invention, the direction in which the ring is spring-biased is approximately centrally to the shaft of the lacquering/inking cylinder so as to bias the lacquering-/inking cylinder in a direction for engaging with the other of the pair of cylinders, and for disengaging from the impression cylinder.

In accordance with again an added feature of the invention, the direction in which the ring is spring-biased is approximately along the line extending substantially from the axis of the lacquering/inking cylinder to the axis of the other of the pair of cylinders.

In accordance with again an additional feature of the invention, the run-up channel is formed in the ring between a circumferential edge of the ring and a crest of the control cam, the other bracing stop being received in the run-up channel in a position of the lacquering-/inking cylinder wherein it is disengaged from the other of the pair of cylinders.

In accordance with a concomitant feature of the invention, the lacquering/inking cylinder is a rubber-covered cylinder.

This construction according to the invention results in a rotary printing press with a lacquering and printing-plate unit, respectively, having an engagement and disengagement device which can be made with great precision of construction and, thus, also permits great precision of the engagement and disengagement motions thereof. This is of particular significance with regard to high-speed rotary printing presses. The advantages are also of considerable importance with respect to lacquering units of rotary printing presses. To effect a disengagement from the impression cylinder, the ring is turned so that one of the support or bracing stops is able to enter into an indentation or insert channel. The entry of the stop into the indentation is caused by spring loading or bias. For this purpose, the spring also has the function of maintaining the lacquering/inking cylinder in contact position with the metering or plate cylinder. In this position, the control cam already cooperates with the other support or bracing stop. When the latter support stop is swivelled, a disengagement motion away from the metering/plate cylinder occurs. If the indentation section or insert channel remains in a position in which the appertaining support or bracing stop is unable to be received therein, and if the other support stop is displaced, only a disengagement away from the metering/plate cylinder in a direction opposite to that of the spring loading or bias occurs. All of the disengagement motions are most markedly centrally directed, particularly the disengaging motion with respect to the impression cylinder. The overall construction is optimized by a multiple-change function of the spring so that it is responsible, on the one hand, for the engagement motion from the impression cylinder. Each of the disengagement motions can be initiated independently of the other. For this purpose, use is made of the disengagement stop, which is present in any case. The most marked radial engagement and disengagement motion prevents circumferential roll-off. It has been found that it is unnecessary to apply any lost motion or take up any slack in the control means in order to turn or rotate the ring; although the ring turns slightly when the support or bracing stop is displaced, this has no effect, because the other support or bracing stop can lie at a sufficient distance in front of the (sharp) transition location between the circular circumference of the ring and the insert channel.

Other features which are considered as characteristic for the invention are set forth in the appended claims.

Although the invention is illustrated and described herein as embodied in a rotary printing machine with device for engaging a lacquering/rubber-covered cylinder with and disengaging it from an impression cylinder and/or a metering/plate cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
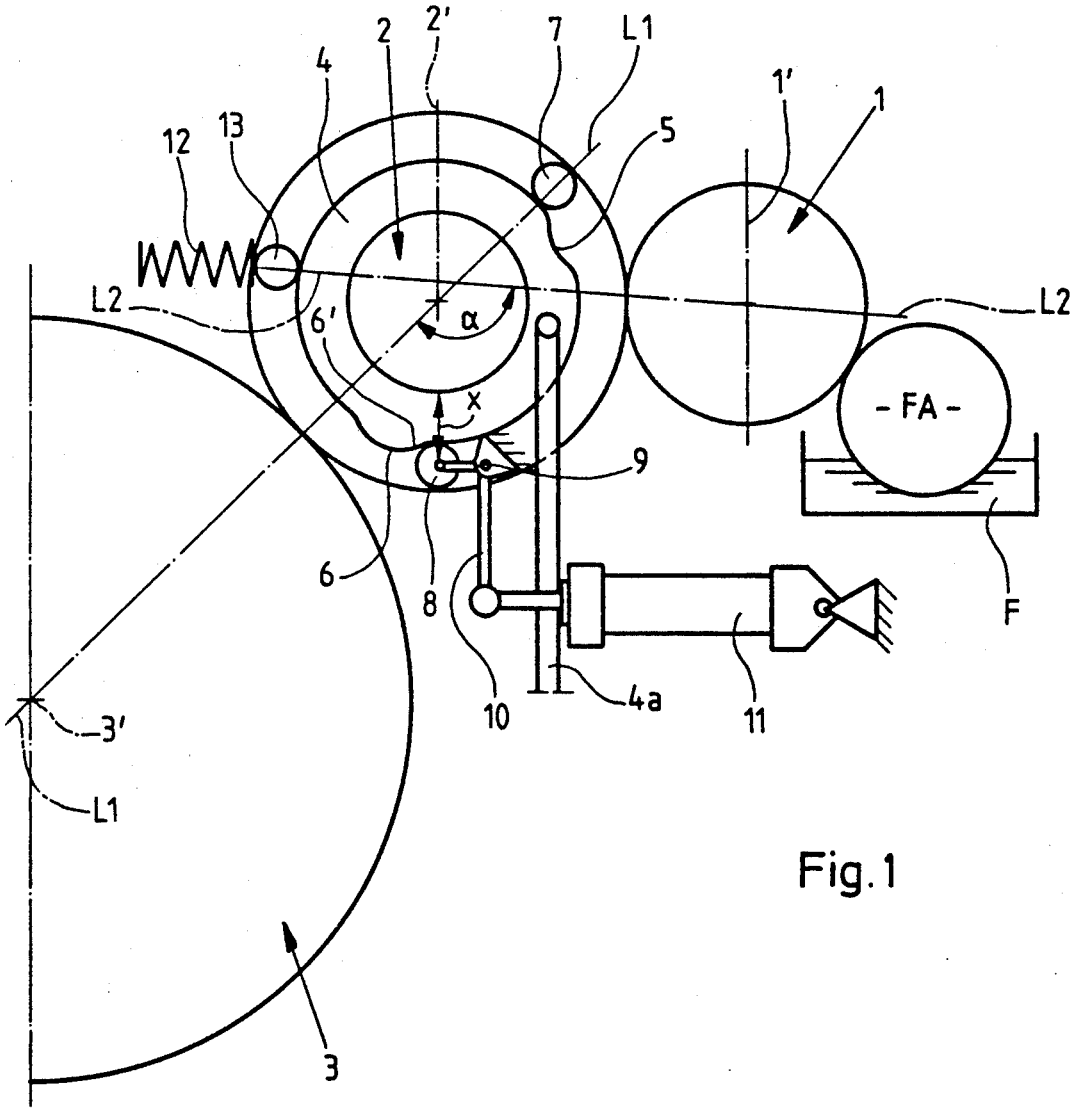
FIG. 1 is a diagrammatic side elevational view of an arrangement of three cylinders including a lacquering-/rubber-covered cylinder in contact with two adjacent cylinders, namely an impression and a metering cylinder, in accordance with the device of the invention.
Figure 2:
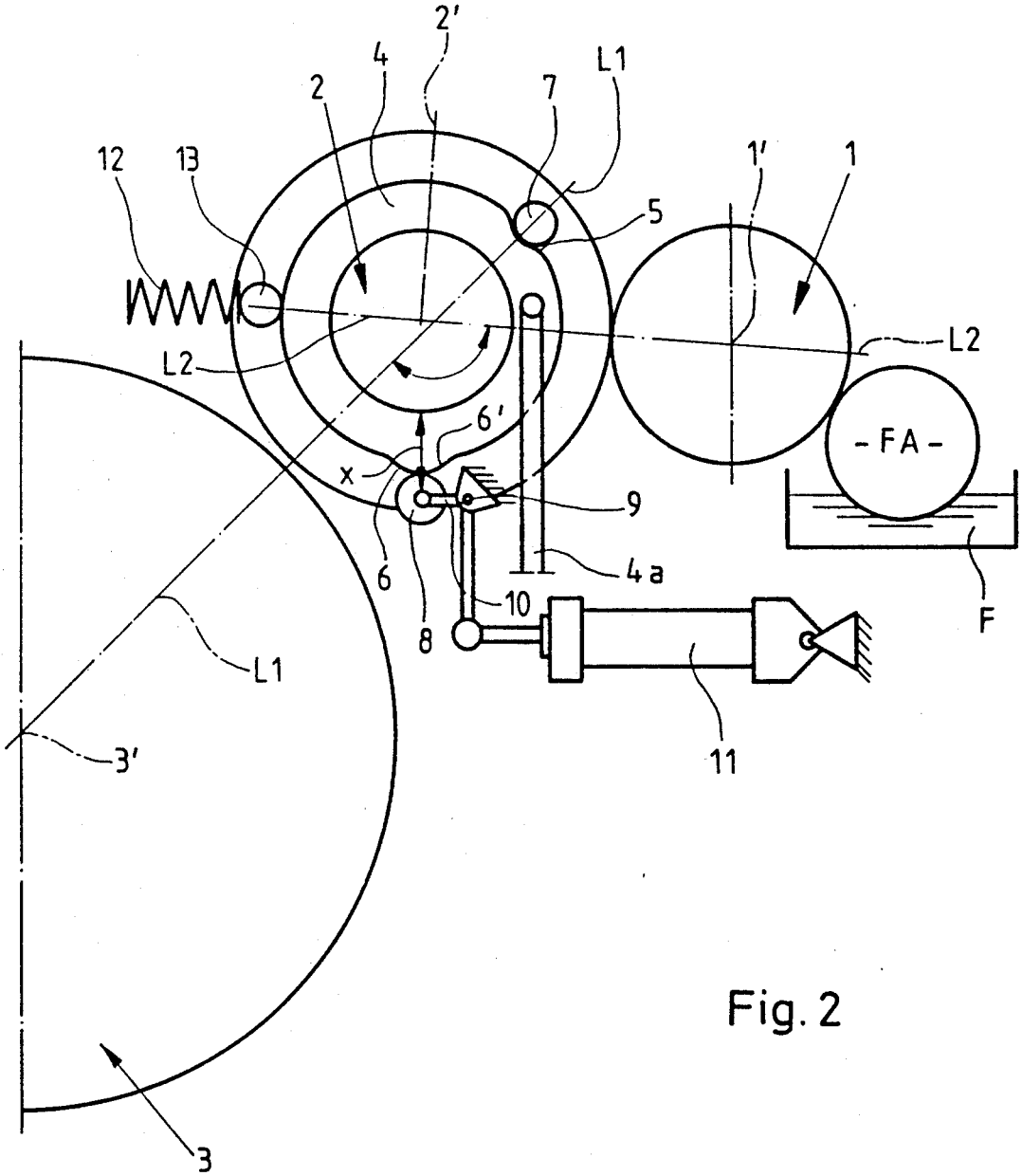
FIG. 2 is a view like that of FIG. 1 wherein the lacquering/blanket cylinder is disengaged from the impression cylinder in another operating phase of the device according to the invention.

Referring now to the drawing and, first, particularly to FIG. 1 thereof, there is shown therein, not in the entirety thereof, an offset rotary printing press, described hereinafter as of the lacquering unit type, which includes a metering cylinder 1, a lacquering cylinder 2 and an impression cylinder 3. Disposed upstream of the metering cylinder 1, in a conventional manner, is an inking unit F with a merely diagrammatically indicated inking roller FA and otherwise not shown in detail. If the printing press has been made ready for printing, whereby the cylinder 1 is a plate cylinder, a dampening unit is additionally disposed, in a conventional manner, upstream of the inking unit F as viewed in direction of rotation of the cylinder 1.

All three cylinders 1, 2 and 3 have shafts 1', 2' and 3', respectively. The shafts 1' and 2' lie approximately on a straight line L2—L2. The shafts 2' and 3' lie on a straight line L1—L1. Both straight lines together enclose an (obtuse) angle $\alpha$. The straight line L2—L2 is a connecting line for a spring bracing or support of the shaft 1'.

A ring 4 is seated on the shaft 2' of the lacquering cylinder 2. The ring 4 is rotatable with respect to the shaft 2'. Rotation thereof is accomplished by displacement of a control rod 4*a*. The ring 4 has an insert channel or flute 5 and a control cam 6. The insert channel 5 is assigned to a bracing or support stop 7, and the control cam 6 is assigned to a bracing or support stop 8.

The bracing stop 8 is in the form of a roller seated on a free end of an angle lever or bellcrank 10 which is swivellable about a fixed point 9. The swivelling motion of the lever 10 is effected by a hydraulic cylinder 11, for example, or in any other suitable manner. The direction of displacement of the lever 10 represented by the arrow x lies approximately radially with respect to the vertex of the angle $\alpha$.

The bracing or support stop 8 lies in a suitably concave run-up channel or flute 6' formed in the cam 6 when the two cylinders 1 and 3 are both engaged by the lacquering cylinders 2 and, in particular, when the lacquering cylinder 2 is in engagement only with the impression cylinder 3.

The ring 4 is subject to a loading of a compression spring 12 which acts, through the intermediary of a pressure roller 13, on the circumferential surface of the ring 4. The spring loading acts in a direction which is approximately a straight line L2—L2, i.e. it is substantially centrally directed towards the shaft 2' of the lacquering cylinder 2 and so that there is also a loading in the direction of engagement with the metering cylinder 1.

The bracing or support stop 7 lies on a straight-line extension of the line L1—L1.

Figure 3:
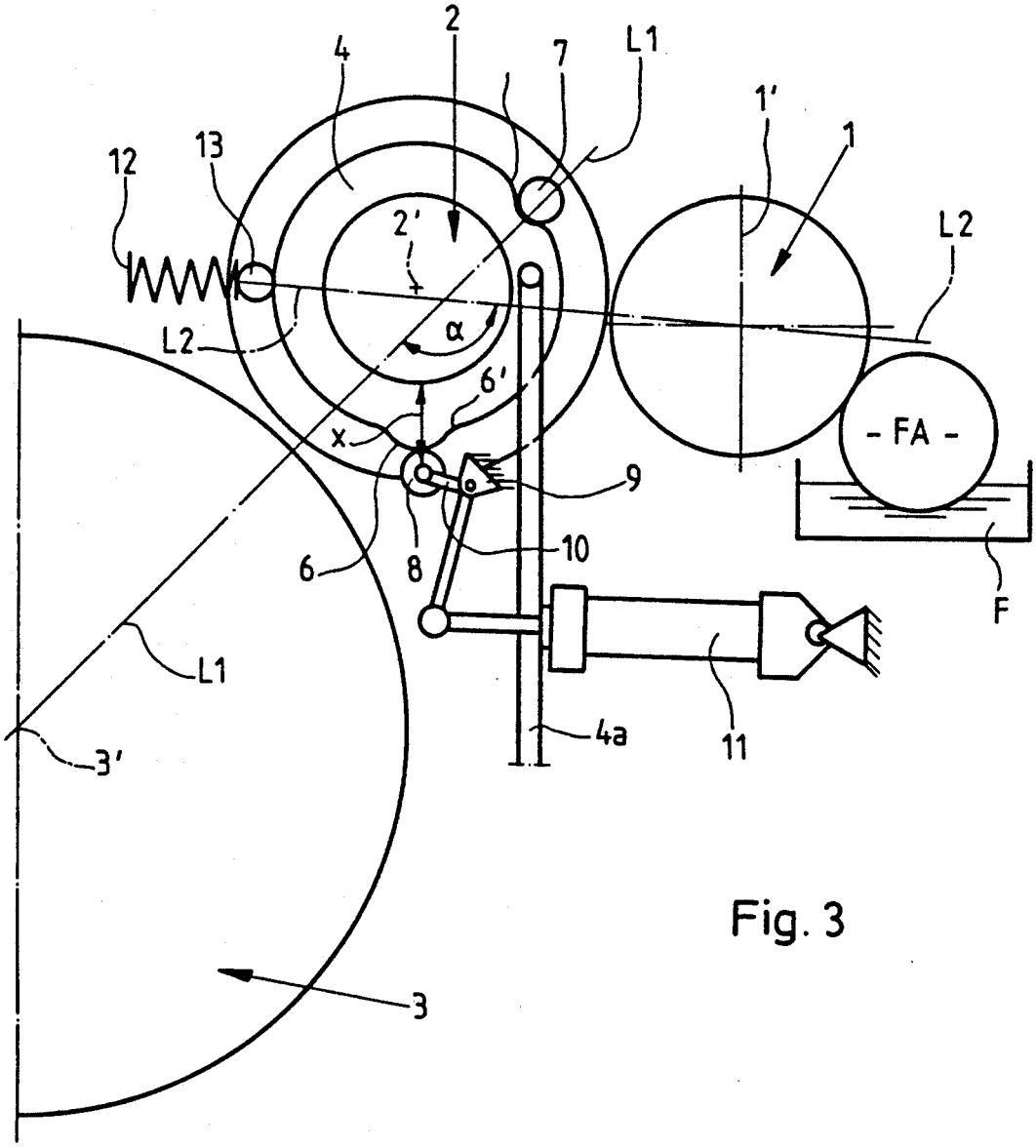
FIG. 3 is yet another view like that of FIGS. 1 and 2 wherein the lacquering/blanket cylinder is disengaged from both of the adjacent cylinders, in accordance with the device of the invention.
Figure 4:
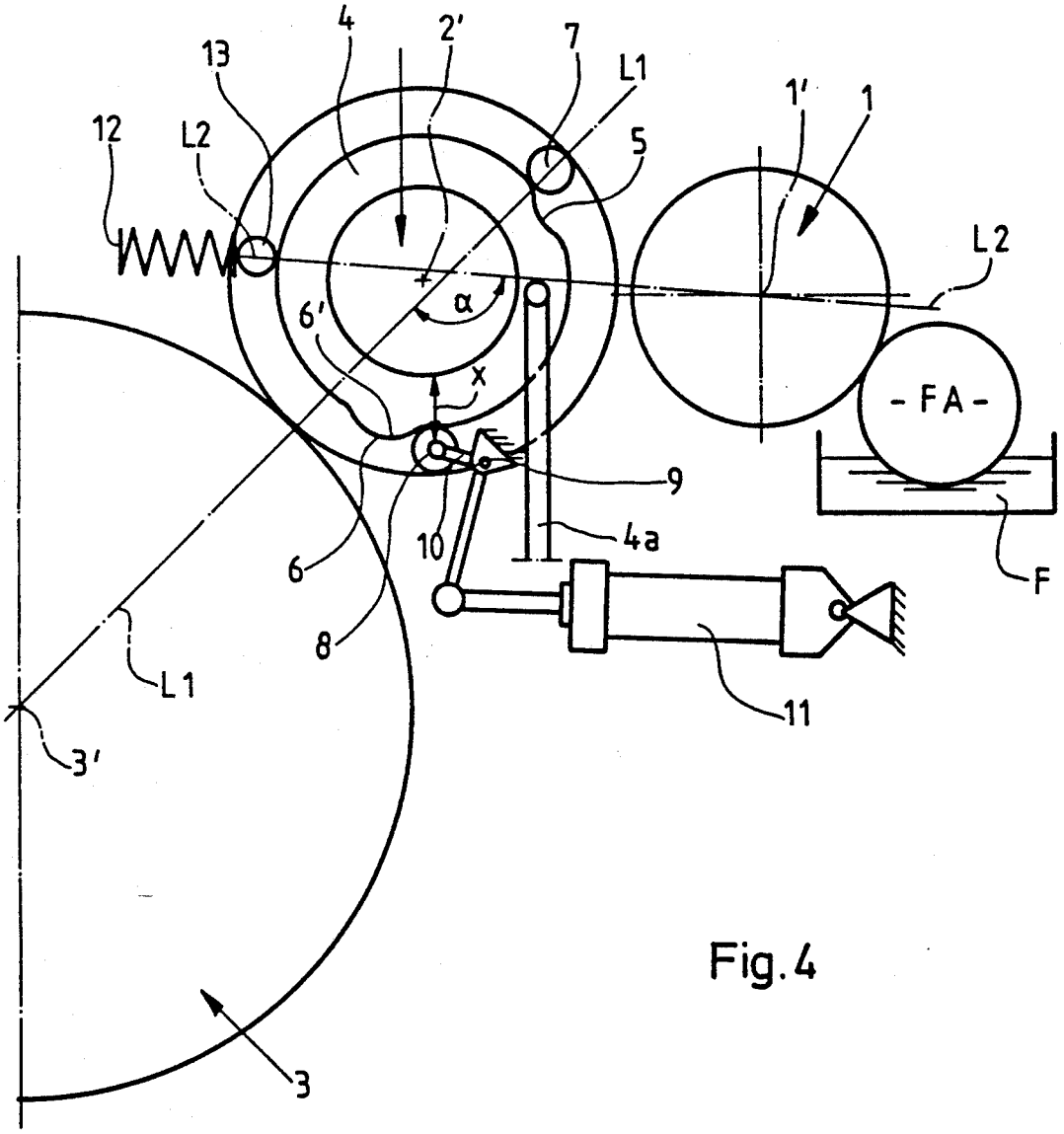
FIG. 4 is a final view like that of FIGS. 1 to 3 wherein the lacquering/blanket cylinder is disengaged only from the metering cylinder.

Starting from the position shown in FIG. 1, disengagement of the lacquering cylinder 2 from the impression cylinder 3 can be effected by turning the ring 4. This is effected by the introduction of the bracing or support stop 7 into the insert channel 5 and by the run up of the apex or crown of the control cam 6 onto the bracing or support stop 8. In this regard, the loading by the spring 12 has a supporting or assisting effect in the direction of disengagement from the impression cylinder 3. The position shown in FIG. 3 results from swivelling the lever 10 and, thus, from raising the bracing or support stop 8; the lacquering cylinder 2 is disengaged both from the metering cylinder 1 and from the impression cylinder 3. Starting from the position of FIG. 3, if the bracing or support stop 8 is raised without simultaneously or previously turning the ring 4, only a disengagement of the lacquering cylinder 2 from the metering cylinder 1 occurs. In this case also, a swivelling of the lacquering cylinder shaft 2' essentially occurs about the contact location of the ring 4 on the bracing support stop 7.

The foregoing is a description corresponding in substance to German Application P 39 26 088.7, dated Aug. 7, 1989, the International priority of which is being claimed for the instant application, and which is hereby made part of this application. Any material discrepancies between the foregoing specification and the aforementioned corresponding German application are to be resolved in favor of the latter.

I claim:

1. In a rotary printing machine, a lacquering/inking cylinder mounted on a shaft, a pair of additional cylinders including a n impression cylinder, and a device for bringing the lacquering/inking cylinder into and out of engagement with at least one cylinder of said pair of additional cylinders, comprising a substantially circular ring turnably disposed on the lacquering/inking cylinder, two bracing stops disposed adjacent said ring, spring means operatively engageable with said ring for biasing said ring towards said two bracing stops and in a direction towards the other cylinder of the pair of cylinders, an indentation formed on said ring at a section of the circumference thereof, means for turning said ring on the shaft so as to move the indented section of said circumference thereof into a position opposite one of said bracing stops for bringing the lacquering/inking cylinder out of engagement with the impression cylinder, the other of said bracing stops being displaceably disposed in a region defined by a first line connecting respective axes of the lacquering/inking cylinder and the impression cylinder, and a second line separating said two bracing stops and extending substantially from the axis of the lacquering/inking cylinder to the axis of the other cylinder of the pair of additional cylinders and intersecting with said first line, and means actuatable by remote control for displacing the other of said bracing stops.

2. Device according to claim 1, wherein the other cylinder of the pair of additional cylinders is a metering cylinder.

3. Device according to claim 1, wherein the other cylinder of the pair of additional cylinders is a plate cylinder.

4. Device according to claim 1, including a control cam formed on said ring, said displaceable other of said bracing stops being cooperatively engageable with said control cam.

5. Device according to claim 1, wherein said one of said bracing stops is disposed on a rectilinear extension of said line connecting the respective axes of the lacquering/linking cylinder and the impression cylinder, and including an insert channel forming said indentation at said section of the ring circumference, said one bracing stop being cooperatively receivable in said insert channel.

6. Device according to claim 4, including a fixed bearing, and a lever which is swivellable about said fixed bearing, said other bracing stop being seated on said lever.

7. Device according to claim 1, wherein said direction in which said ring is spring-based extends closely adjacent and transversely to the shaft of the lacquering/inking cylinder so as to bias the lacquering/inking cylinder in a direction for engaging with the other cylinder of the pair of additional cylinders, and for disengaging from the impression cylinder.

8. Device according to claim 7, wherein said direction in which said ring is spring-biased is approximately along the line extending substantially from the axis of the lacquering/inking cylinder to the axis of the other cylinder of the pair of additional cylinders.

9. Device according to claim 4, wherein said ring is formed with a circumferential edge and said control cam is formed with a crest, and a run-up channel is formed in said ring between said circumferential edge of said ring and said crest of said control cam, said other bracing stop being received in said run-up channel in a position of the lacquering/inking cylinder wherein it is disengaged from the other cylinder of the pair of additional cylinders.

10. Device according to claim 1, wherein the lacquering/inking cylinder is a rubber-covered cylinder.

* * * * *